United States Patent [19]

James

[11] Patent Number: 4,706,413

[45] Date of Patent: Nov. 17, 1987

[54] SMOKE DETECTOR-ACTIVATED DOOR SEAL

[76] Inventor: Kenneth S. James, 4169 E. 188th St., Cleveland, Ohio 44122

[21] Appl. No.: 919,441

[22] Filed: Oct. 16, 1986

[51] Int. Cl.[4] ..... E05F 15/20

[52] U.S. Cl. ..... 49/477; 49/31

[58] Field of Search ..... 449/477, 31

[56] References Cited

U.S. PATENT DOCUMENTS

| | | | |
|---|---|---|---|
| 3,302,333 | 2/1967 | Ganzinotti et al. | 49/477 X |
| 3,507,974 | 4/1970 | Clark et al. | 49/477 X |
| 3,769,750 | 11/1973 | Mayer et al. | 49/477 |
| 3,908,309 | 9/1975 | Coulter et al. | 49/31 |
| 3,968,597 | 7/1976 | Hirtle | 49/477 |
| 4,034,437 | 7/1977 | Robertson et al. | 49/31 X |
| 4,073,521 | 2/1978 | Mena | 49/477 X |
| 4,335,075 | 6/1982 | Kackos | 49/477 X |
| 4,441,278 | 4/1984 | Covey | 49/477 |

FOREIGN PATENT DOCUMENTS

| | | | |
|---|---|---|---|
| 499035 | 1/1939 | United Kingdom | 49/477 |

*Primary Examiner*—Philip C. Kannan

*Attorney, Agent, or Firm*—Wayne D. Porter, Jr.

[57] ABSTRACT

A smoke detector-activated door seal includes an extensible member in the form of an inflatable bladder disposed about the periphery of the door. A source of compressed air is connected to the bladder such that, upon a door-carried smoke detector sensing the presence of smoke, the source of compressed air inflates the bladder so as to provide a substantially airtight seal between the door and the door frame. A manually actuated release valve is provided to enable the seal to be released whenever desired.

8 Claims, 5 Drawing Figures

SMOKE DETECTOR-ACTIVATED DOOR SEAL

BACKGROUND OF THE INVENTION

1. Field of the Invention

The invention relates to door seals and, more particularly, to door seals especially effective in preventing the passage of smoke into a room upon the occurrence of a fire.

2. Description of the Prior Art

High rise structures such as apartment buildings and hotels pose considerable dangers in the event of a fire. People occupying rooms in the upper floors of such structures are particularly exposed to danger because of the difficulty in bringing rescue equipment to the scene and in effectively utilizing the rescue equipment in the upper portions of the buildings. Despite the difficulties associated with carrying out rescue operations, the occupants of burning buildings usually can be rescued if enough time is made available to the rescuers. Unfortunately, the hazards of a fire are such that it is difficult to obtain enough time to carry out a rescue operation. In large measure this is because it is not fire itself which causes most of the fatalities, but rather smoke and fumes generated by burning materials which eventually leads to asphyxiation or poisoning of the inhabitants of the buildings. The smoke spreads more rapidly through the building than the fire itself on many occasions. The rapid spread of smoke is caused in part by natural drafts that circulate in a building due to temperature differentials and "chimney effects," and in part due to the existence of air conditioning systems. The problem is made worse in certain buildings by the presence of plastics materials that produce extremely toxic fumes.

It is common practice in high rise structures, particularly public facilities such as hotels, for smoke detectors to be installed in the rooms and common areas such as hallways. Unfortunately, although smoke detectors will provide a warning that a fire is in progress, the knowledge that a fire is in progress may not be sufficient to enable the inhabitants to avoid the toxic effects of the smoke until they can be rescued. Such techniques as creating an emergency seal by forcing sheets or towels around a door frame are not particularly effective and often cannot be carried into practice by certain individuals, especially in the face of an actual emergency. The existence of an effective seal about the periphery of the door could delay the entrance of toxic smoke and fumes into the room long enough for effective rescue operations to be carried out.

SUMMARY OF THE INVENTION

In response to the foregoing and other considerations, the present invention provides a new and improved seal for use with doors that are supported by a frame and movable relative thereto. The invention includes an extensible member disposed about the periphery of the door, the extensible member being movable between a retracted position in which the door can be opened and closed, and an extended position in which a substantially airtight seal is formed between the door and the frame. The invention also includes means for selectively moving the extensible member from the retracted position to the extended position.

In the preferred embodiment, the extensible member is in the form of an inflatable bladder carried by the door. The door includes a channel about its periphery into which the bladder is tightly fitted. The means for selectively moving the extensible member includes a source of compressed air such as a bottle of compressed air or a battery operated pump. A sensor in the form of a smoke detector is provided, which sensor is connected to a control which, in turn, is connected to the source of compressed air.

Upon the occurence of a fire, the smoke detector will sense the presence of smoke and will cause the source of compressed air to be activated. Assuming that the door is closed, the bladder will be expanded so as to create a substantially airtight seal between the door and the frame. A manually activated release valve is provided for the bladder. If it is necessary or desirable for the door to be opened after the bladder has been inflated, the release valve can be activated so as to collapse the bladder, thereby permitting the door to be moved.

The door seal according to the invention is relatively inexpensive and easy to install. The automatic and effective nature of its operation is such that occupants of rooms in high rise structures will have more time available in which to be rescued or to rescue themselves. The foregoing and other features and advantages of the invention will be apparent from reviewing the following description and claims, taken in conjunction with the accompanying drawings.

DESCRIPTION OF THE PREFERRED EMBODIMENT

Figure 1:
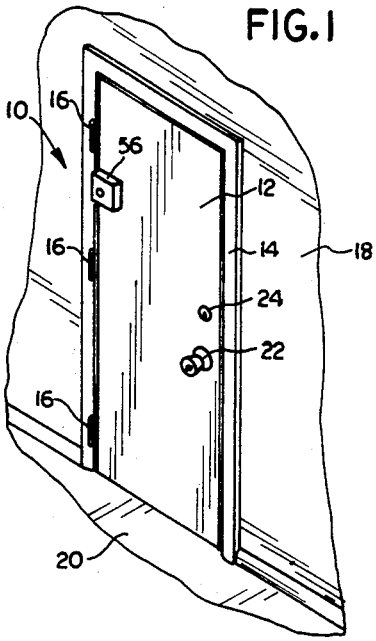
FIG. 1 is a perspective view of a door in which a seal according to the invention has been installed.
Figure 2:
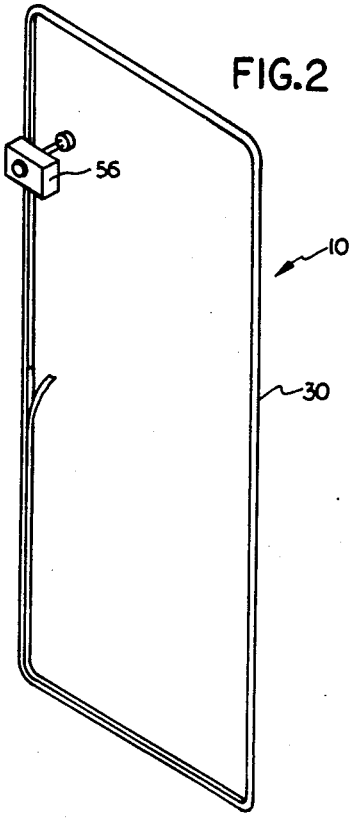
FIG. 2 is a perspective view of a door seal according to the invention standing alone.

Referring particularly to FIGS. 1 and 2, a door seal according to the invention is indicated generally by the reference numeral 10. The seal 10 is adapted to be used with a door 12 supported by a frame 14 and movable relative thereto by means of hinges 16. The frame 14 is mounted in an opening formed in a wall 18, and the door 12 moves back and forth above a floor 20. The door 12 includes such conventional hardware as a keyset 22 and a dead bolt 24. The door 12 can be of any well known construction, although it is expected that the door 12 will have a hollow core as is common in many recently constructed buildings.

The seal 10 includes an extensible member 30 disposed about the periphery of the door 12. In the preferred embodiment, the extensible member 30 is in the form of an inflatable bladder made of rubber or plastics material. It will be appreciated that the extensible member 30 can take forms other than an elongate, inflatable bladder. It also will be appreciated that the extensible member 30 can be mounted to the frame, rather than to the door. The most important functional requirement of the extensible member 30 is that it be capable of expanding quickly to effect a substantially airtight seal between the door 12 and the frame 14 (and also the floor 20).

Figure 3:
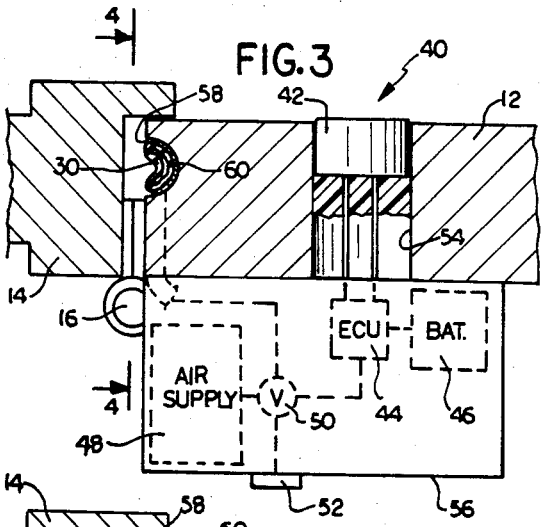
FIG. 3 is a schematic, cross-sectional view of a portion of the door of FIG. 1.

The seal 10 includes means for selectively moving the extensible member 30 from a retracted position in which the door 12 can be opened and closed, and an extended position in which a substantially airtight seal is formed. The means for selectively moving the extensible member 30 is indicated in FIG. 3 by the reference numeral 40 and includes a sensor 42 such as a conventional battery-powered smoke detector, an electronic control unit 44 connected to the sensor 42, a battery 46 connected to the control unit 44, a source of compressed air 48 operably connected to the bladder 30, a diverter valve 50 connected intermediate the control unit 44 and the air source 48, and a release button 52 connected to the diverter valve 50. The air source 48 can be a bottle of compressed air or a battery-operated pump. An opening 54 is formed through the door 12 such that the sensor 42 forms an outer surface of the door 12.

Figure 4:
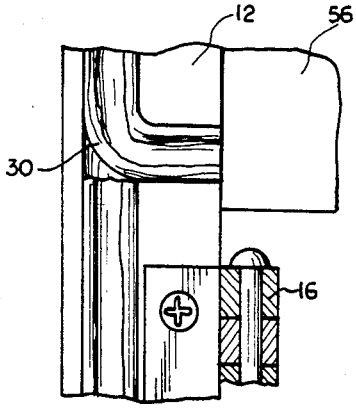
FIG. 4 is a view of the door of FIG. 3 taken along a plane indicated by line 4—4 in FIG. 3.

The control unit 44, the battery 46, the air supply 48, the valve 50, and the release button 52 are carried by a box 56 which is secured to the inner surface of the door 12. The valve 50 is connected to the bladder 30 by an opening (not shown) formed in the door 12. The door 12 also is provided with a peripheral channel 58 within which the bladder 30 can be fitted and secured by adhesive 60, if desired. Referring particularly to FIG. 4, the bladder 30 extends completely around the periphery of the door and terminates near the box 56.

Figure 5:
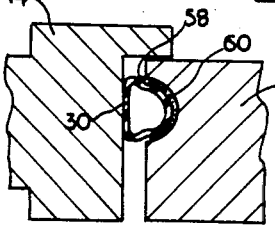
FIG. 5 is a view similar to FIG. 3 showing the seal in its extended position.

In operation, if the sensor 42 should detect the presence of smoke, the control unit 44 will be activated which, in turn, will activate the valve 50 such that air from the air source 48 is diverted into the bladder 30. The bladder 30 will be inflated to that configuration shown in FIG. 5, whereupon a substantially airtight seal between the door 12 and the frame 14 and the floor 20 will be effected.

If the occupant of the room should desire to open the door, the button 52 can be pressed so as to open the diverter valve 50. In turn, air will be released from the bladder 30 permitting the door 12 to be opened.

It will be appreciated from the foregoing description that the seal 10 can be fabricated relatively inexpensively and installed on either new doors or existing doors with relatively little difficulty. The seal 10 is sufficiently simple in construction and operation that it should be exceedingly reliable, both in automatically effecting a substantially airtight seal when needed, and in releasing that seal when desired.

Although the invention has been disclosed in its preferred form with a certain degree of particularity, it will be understood that the present disclosure of the preferred embodiment has been made only by way of example and various changes in the details of construction and combination and arrangement of parts may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. A seal for use with a door supported by a frame and movable relative thereto, the seal comprising:

an extensible member secured to, and disposed about, the periphery of the door, the extensible member being in the form of a bladder movable between a retracted position in which the door can be opened and closed, and an extended position in which a substantially airtight seal is formed between the door and the surrounding frame and floor; and means for selectively inflating the bladder to its extended position, the means for inflating the bladder including a sensor in the form of a smoke detector for detecting the presence of smoke, a source of compressed air operatively connected to the bladder, the source of compressed air being mounted to the door, and a control for the source of compressed air, the control being activated by the sensor upon the sensor sensing the presence of smoke.

2. The seal of claim 1, wherein the bladder is secured to the door by means of adhesive.

3. The seal of claim 1, further comprising a channel formed in the periphery of the door, the channel being of a size and shape to receive the bladder in its non-inflated condition.

4. The seal of claim 1, further comprising a manually activated release valve for releasing air in the bladder so as to permit the bladder to be moved to the retracted position.

5. The seal of claim 1, wherein the source of compressed air is a bottle of compressed air.

6. The seal of claim 1, wherein the source of compressed air is a battery-operated pump.

7. The seal of claim 1, wherein the means for selectively inflating the bladder to its extended position includes a box disposed on one side of the door, the source of compressed air and the control being disposed within the box, and the sensor extending from the box, through the door, and opening through a surface of the other side of the door.

8. The seal of claim 7, further including a manually activated release valve for permitting the bladder to be moved to the retracted position, the release valve being connected intermediate the source of compressed air and the bladder, the release valve opening through a surface of the box.

* * * * *